United States Patent [19]

Bott

[11] Patent Number: 4,606,566

[45] Date of Patent: Aug. 19, 1986

[54] BAR TYPE LOCK

[76] Inventor: Ned Bott, 1163 Tr. 2156 Rt. #4, Ashland, Ohio 44805

[21] Appl. No.: 605,229

[22] Filed: Apr. 30, 1984

[51] Int. Cl.[4] ..... E05C 5/02

[52] U.S. Cl. ..... 292/57; 70/134

[58] Field of Search ..... 70/129, 130, 131, 132, 70/133, 134; 292/57, 58, 59, 60, 61, 218, 259, 4

[56] References Cited

U.S. PATENT DOCUMENTS 1,707,694 4/1929 Torrence ..... 292/259

2,163,206 6/1939 Lopez ..... 292/259

FOREIGN PATENT DOCUMENTS 622193 4/1949 United Kingdom ..... 292/4

*Primary Examiner*—Robert L. Wolfe

*Attorney, Agent, or Firm*—Fay, Sharpe, Fagan, Minnich & McKee

[57] ABSTRACT

A bar type lock mechanism including a locking bar for selectively locking a door having a first edge and a second edge, wherein one of the edges is positioned adjacent a striker plate when the door is closed. The locking bar includes a first end having a locking portion and a second end having a handle portion. A frame assembly secured to the door is provided for slidably and rotatably supporting the locking bar for movement between a retracted position and a projected position. The frame assembly is adjustable to advantageously accommodate doors of different widths. The locking portion of the locking bar is provided with a flattened side as well as a curved side. When the locking bar is first placed in its projected position, the flattened side of the locking portion contacts the striker plate. Afterwards, the locking bar can be rotated to its curved side to generate a camming action thereby more securely closing the door.

22 Claims, 9 Drawing Figures

BAR TYPE LOCK

BACKGROUND OF THE INVENTION

This invention relates generally to door locks. More specifically, the present invention relates to an improved safety bar lock for holding a door in a closed position. Although the invention will be described with particular reference to a bar type door lock for a hinged door, it will be recognized that certain features thereof may be used or adapted for use with sliding doors as well as with roll-up doors, such as garage doors.

At present, the prevention of unwelcome entry to premises through the doors thereof is made difficult by the ease with which conventional locks on such doors can be disabled. In an attempt to remedy this defect, several conventional reinforced door locks have been developed. These locks, however, have not solved all the problems which exist with regard to the security of premises.

For example, one conventional reinforced door lock which is used as an auxiliary lock or latch for a hinge-mounted door includes a holding rod which is mounted in a hinge of the door. A bar is provided in a longitudinally extending bore which is received on a free end of the holding rod. The bar is adapted to slide on the rod so as to be movable from a retracted position to a projected or locking position in which a free end of the bar is received in a hinge plate. It would, however, be useful to provide a door lock which can accommodate doors of different widths and which has a camming action for the tip of the bar so that the door can be shut more tightly when the bar is rotated into its locked position. It would also be useful to have a door lock which could be operated from either side of the door.

Another conventional bar-type door locking device designed for use on a sliding door is formed of a tubular part and a rod part. Each of these parts is provided with a plurality of apertures such that a bolt may be inserted through any cooperating pair of apertures to affix the parts relative to each other and simultaneously affix the locking device to an associated door. It would, however, be useful to provide a door lock which can be secured in a door hinge and in which a camming action can be generated to more tightly secure the door. It would also be useful to be able to operate the lock from either side of the door.

The subject invention overcomes the foregoing problems and meets the above stated needs in providing a new and improved bar type lock for doors.

BRIEF SUMMARY OF THE INVENTION

A bar type door lock constructed according to the present invention provides security in addition to that afforded by conventional key operated locks. The lock cooperates with a striker plate mounted on a door frame to securely hold a door in a locked position.

More particularly in accordance with the invention, the bar type lock includes a locking bar which has a first end, including a locking portion, and a second end, including a handle portion. A frame means secured to the door is provided for slidably and rotatably supporting the locking bar for movement between a retracted position and a projected position. The locking portion of the locking bar is provided with a flattened side as well as a curved side. When the locking bar is first placed in its projected position, preferably only the locking bar flattened side contacts the striker plate. At this point, the bar locking portion can be rotated to its curved side for generating a camming action to more securely close the door. In the preferred embodiment, the locking portion is preferably bent or canted with respect to the remainder of the locking bar.

In accordance with another aspect of the invention, the frame means includes first and second frame members with these two members being relatively adjustable with respect to each other so that the door lock can be adjusted for use on different sizes of doors. In this arrangement, one end of the first frame member is secured to a hinge of the door.

According to another aspect of the invention, the frame means preferably further includes a bar brace. This bar brace is secured to the door and functions to strengthen and guide the locking bar.

According to a further aspect of the invention, the locking bar and the frame members are both positioned on a first side of the door, and means are provided on a second side of the door to effect door opening and closing from the second side. The means on the second side of the door may include a square shank rod adapted for rotation and a handle connected to a first end of the square shank rod to effect selective rotation thereof.

In accordance with yet another aspect of the invention, a housing means for housing the square shank rod may also be provided along with a plate means secured to a second end of the square shank rod. The plate means is operably connected to the locking bar whereby rotation of the square shank rod will rotate the plate means to move the locking bar. The handle means preferably includes a key cylinder which needs to be actuated by a key-like member to enable the handle to be turned.

According to another aspect of the invention, a pair of stop members are provided on the locking bar to serve as end stops for locking bar movement. These stop members may comprise pins, such as cotter pins or the like.

A principal advantage of the invention is the provision of an improved bar type lock for a door.

An additional advantage of the invention is the provision of such a lock which is adaptable to use with different widths of doors.

A further advantage of the invention resides in a new bar type lock having a camming action to more securely lock the door.

Still another advantage of the invention is the provision of a bar type lock which can be actuated from either side of a door.

Yet another advantage of the invention is the provision of a bar type lock which fits both right and left hand opening doors.

Still other benefits and advantages of the invention will become apparent to those skilled in the art upon a reading and understanding of the following detailed description.

BRIEF DESCRIPTION OF THE DRAWINGS

The invention may take physical form in certain parts and arrangements of parts, preferred and alternative embodiments of which will be described in detail in the specification and illustrated in the accompanying drawings which form a part hereof, and wherein.

DETAILED DESCRIPTION OF THE PREFERRED AND ALTERNATE EMBODIMENTS

Figure 1:
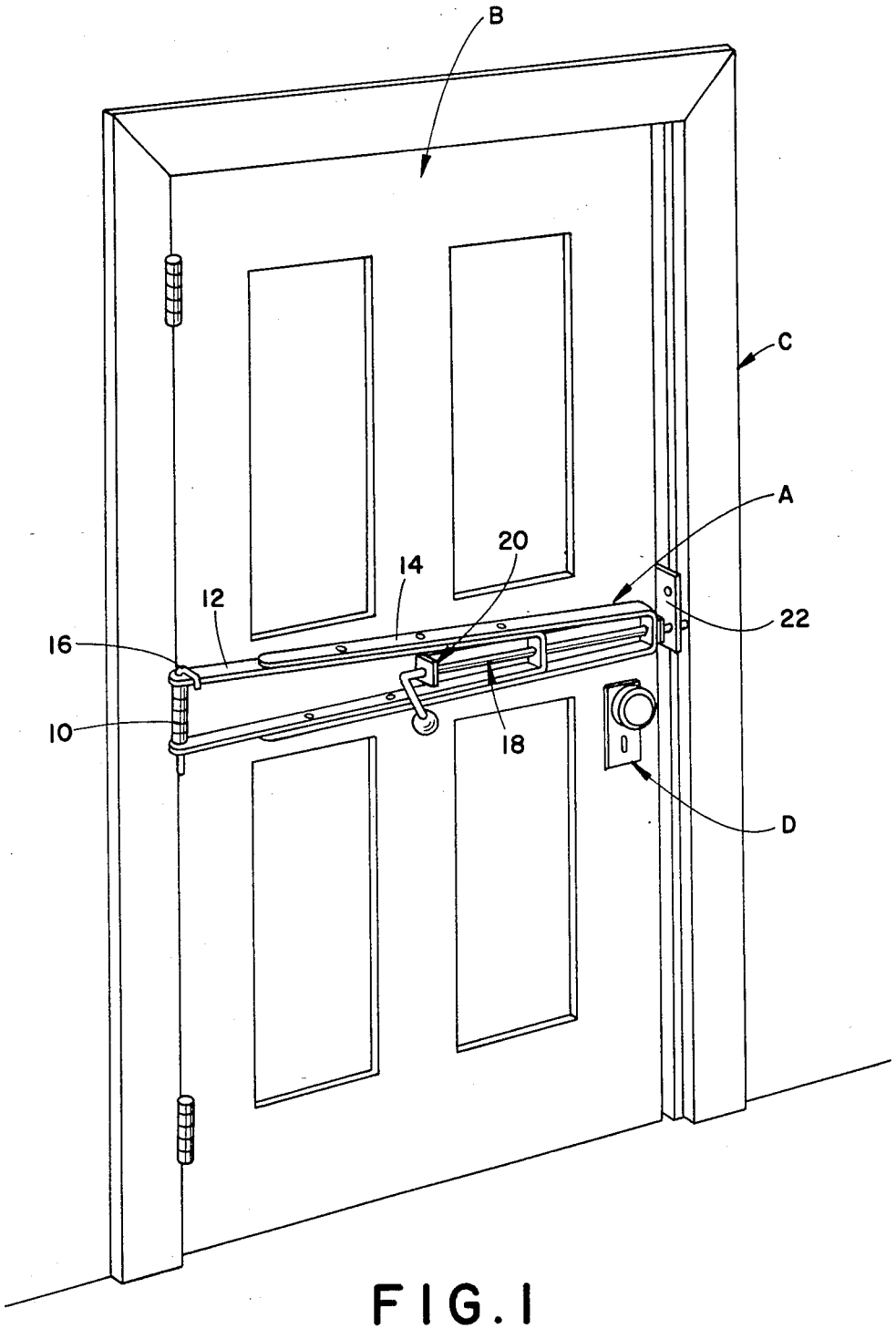
FIG. 1 is a perspective view of a hinged door which is provided with a bar type lock according to the preferred embodiment of the present invention.

Referring now to the drawings, wherein the showings are for purposes of illustrating preferred and alternate embodiments of the invention only and not for purposes of limiting same, FIG. 1 shows a bar type lock A secured to a door B. The door B is hingedly secured to a door frame C and may be provided with a conventional door lock D in addition to the bar type lock A. However, it should be recognized that the bar type lock A may also be the only lock provided on the door B. Preferably, the bar type lock A is secured to a hinge 10 of the door B but it would also be conceivable to secure the bar type lock directly to the door by conventional fastening means. It will be recognized that although the bar type lock A is illustrated as being secured to a hinged door B, it would also be feasible to secure the bar type lock to either a sliding door or to a roll-up door, such as a garage door. It should also be noted that the bar type lock of the present invention is usable for both right and left hand opening doors.

The bar type lock A preferably includes a first frame member 12 and a second frame member 14 with the two frame members being selectively adjustable with respect to each other. The first frame member 12 can be secured to the door hinge 10 by a pin 16. As mentioned, however, other conventional fasteners and techniques could also be used to secure the two frame members 12,14 to the door B. In the case of a two-hinge door, or a door with a center hinge which is in an unacceptable position, a conventional securing means, such as an additional hinge, may be provided for securing the frame members 12,14 to the door. The bar type lock A also includes a locking bar 18 and a reinforcing member or bar brace member 20 in which the locking bar is positioned. A striker plate 22 is secured to the door frame C and is positioned so as to cooperate with the locking bar 18.

As may be seen in FIG. 1, the striker plate C is preferably provided with a pair of apertures through which the locking bar second end 18 can extend. This allows the striker plate C to be mounted either above or below the conventional door lock's D own striker plate (not visible). As with the bar type lock A, the striker plate C can be mounted on a door frame of either a right or left hand door.

Figure 2:
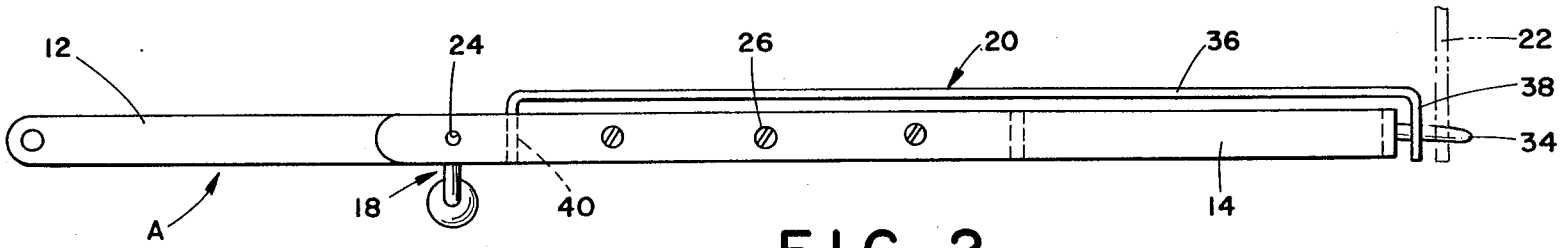
FIG. 2 is an enlarged plan view of the bar type lock of FIG. 1.
Figure 3:
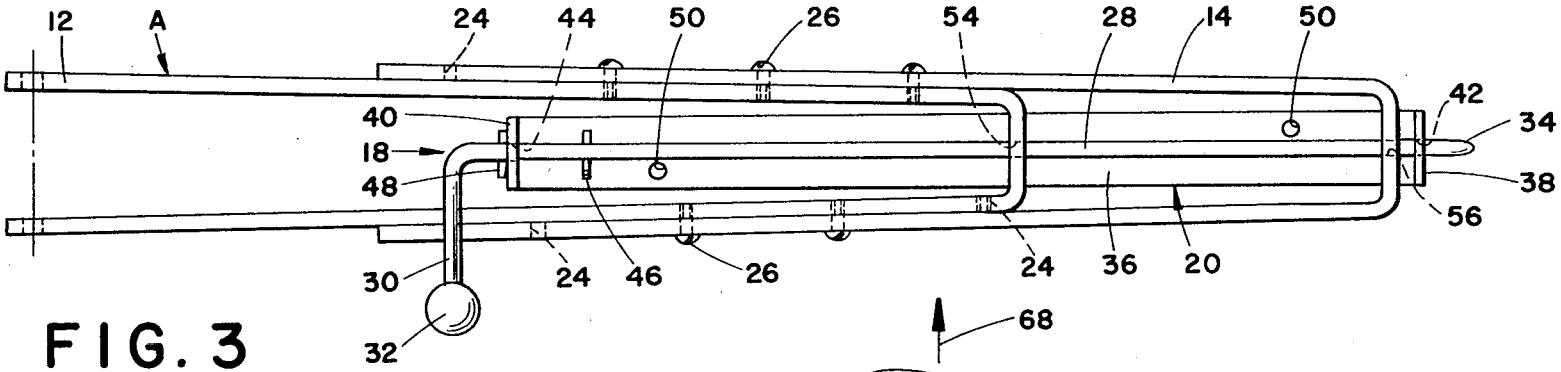
FIG. 3 is a side elevational view of the bar type lock of FIG. 1.

With reference now to the preferred embodiment of FIG. 2, in order to secure the first and second frame members 12,14 to each other, a plurality of fastener apertures 24 are provided on each of the members with a respective fastener 26 extending through at least some of the apertures to fasten the two members 12,14 to each other. With reference now also to FIG. 3, the locking bar 18 has a body portion 28 having a longitudinal axis as well as a first end 30, bent at substantially a right angle to the axis of the body portion to define a handle portion. A knob-type handle 32 may be provided on a free end of the handle portion 30 for ease of manipulation. A second end 34 of the bar body 28 may also be angled or canted with regard to the bar body longitudinal axis to define a locking portion, although the angling is considerably less pronounced than the bar first end. Such angling a (FIG. 5) may be approximately in the range of 3°–8°.

As mentioned, the bar 18 is positioned in the bar brace 20 which has a planar body portion 36 having a longitudinal axis as well as first and second ends 38,40 which are bent or angled with respect to the body portion longitudinal axis. These bent ends 38,40 are positioned generally perpendicularly with respect to the longitudinal axis of the bar brace body portion 36 with the locking bar body 28 extending through respective apertures 42,44 provided in the bent ends of the bar brace 20. Limiting the movement of the bar body 26, with respect to the bar brace 20, are a pair of stop members 46,48, which are secured to the bar body. A first stop member 46 is positioned within the channel defined by the bar brace ends 38,40 with the second stop member 48 being positioned on the other side of the bar brace second end 40. In this way, a limited amount of longitudinal movement is allowed for the bar 18 with the stop members 46,48 contacting the bra brace second end 40 to prevent further movement. These members 46,48 may comprise cotter pins or other suitable, conventional stop members.

One or more apertures 50 are provided in the bar brace 20 to enable it to be fastened via one or more conventional fasteners 52 (FIG. 5) to the door B. Only one fastener is illustrated in FIG. 5 but it should be noted that more than one fastener 52 may be used if so desired when more than one aperture 50 is provided on the bar brace 20.

The bar 18 not only extends through the apertures 42,44 in the bar brace 20, but also extends through an aperture 54,56 in each of the frame members 12,14 as well. All of these apertures 42,44,54,56 are somewhat larger in diameter than is the bar 18 to enable it to slide and rotate freely in the apertures even considering the fact that the bar locking portion 34 may be angled somewhat in relation to the bar body 28.

Figure 4A:
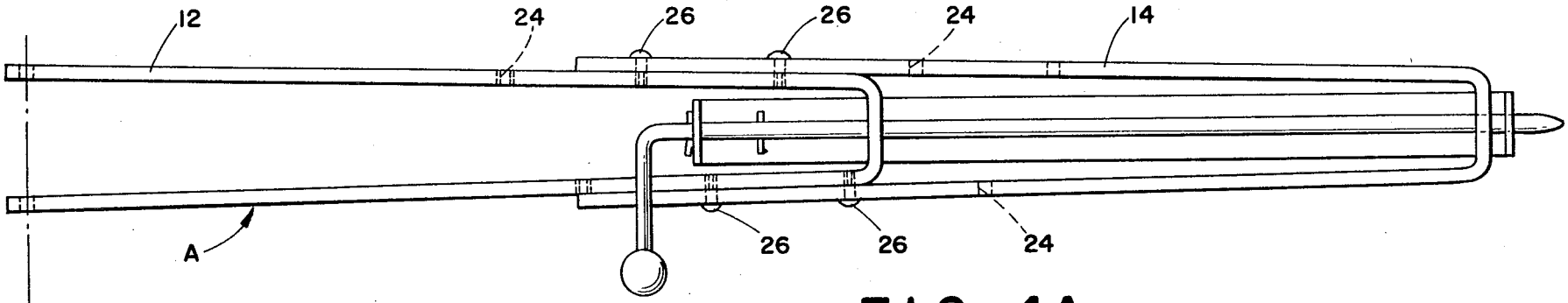
FIG. 4A is a side elevational view of the bar type lock of FIG. 1 adjusted for use on a wide door.
Figure 4B:
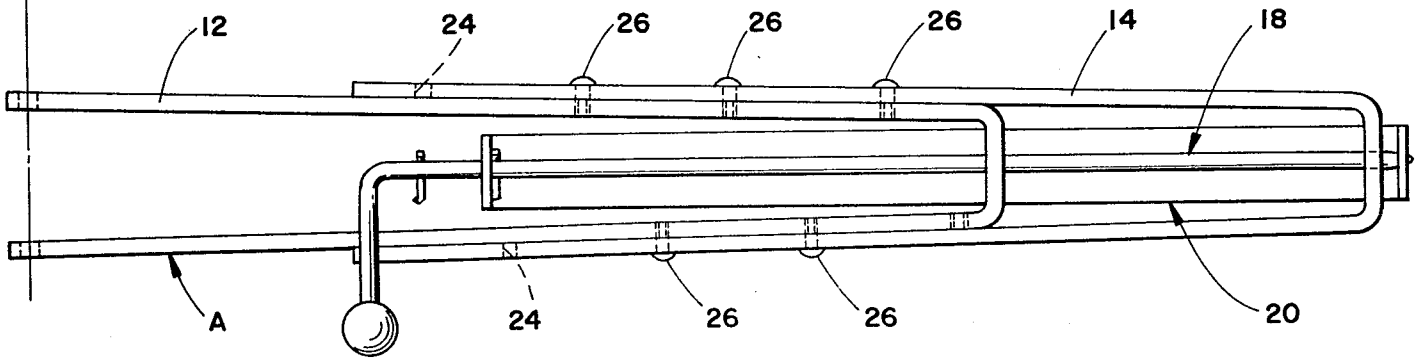
FIG. 4B is a view similar to FIG. 4A with the lock adjusted for use on a narrow door.

With reference now to FIGS. 4A and 4B, the first and second frame members 12,14 are relatively adjustable with respect to each other so that the bar type lock A can be adjusted to fit most conventionally sized door. In this connection, by removing the several fasteners 26 from the respective apertures 24 and sliding the first frame member 12 with respect to the second frame member 14, it is possible to adjust the bar type lock from a door width of, for example, forty four inches as illustrated in FIG. 4A by two inch increments down to a door width of, for example, twenty eight inches as is illustrated in FIG. 4B. The bar type lock A of the present invention is thus able to be fitted to almost all conventional door widths.

Figure 5:
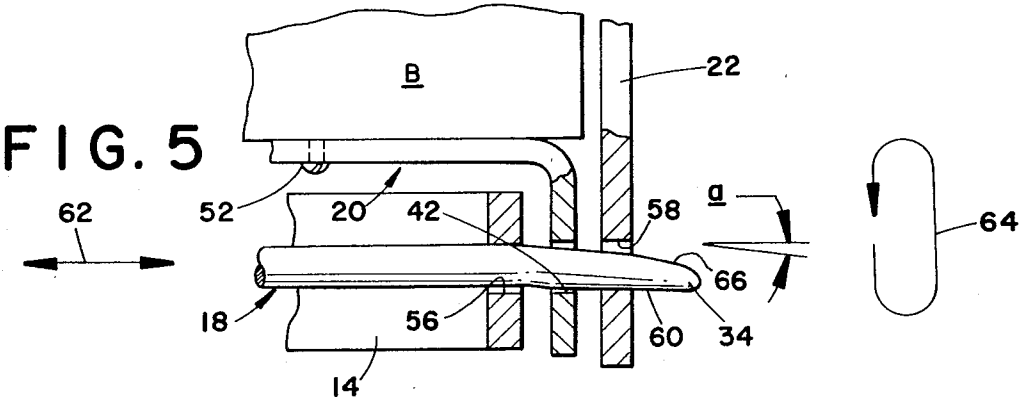
FIG. 5 is an enlarged view in partial cross section showing the locking portion of the bar type lock of FIG. 2.

Referring to FIG. 5, the second end 34 of the locking bar 18 cooperates with the striker plate 22 by extending through an aperture 58 thereof. In this connection, it should be noted that the bar 18 also extends through the aperture 42 of the bar brace 20 as well as through the aperture 56 of second frame member 14. In the closing position of the bar type lock A, the apertures 56,42,58 of the second frame member 14, the bar brace 20, and the striker plate 22, respectively, are aligned to enable the second end 34 of the bar 18 to be slid therethrough.

In order to enhance the sliding motion of the bar second end 34 despite the fact that the second end is angled somewhat with respect to the bar body 28, a flattened portion 60 is provided on the bar second end. This flattened portion 60 enables the easy sliding motion of the bar 24 into the aperture 58 of the striker plate 22. Normally, such sliding motion will occur when the handle portion 28 of the bar 18 is rotated upwardly toward a generally horizontal position from the generally vertical locking position illustrated in FIGS. 2 and 3. When the handle portion 28 is in such a generally horizontal position, the bar 18 can be easily slid horizontally as illustrated by arrow 62. When slid to the right, the bar second end 34 enters the aperture 58 of the striker plate 22 as illustrated in FIG. 5.

Once this is accomplished, the bar 18 can be rotated by moving the handle portion 30 toward its locked or generally vertical position as illustrated by arrow 64. In this way, the locking portion 34 of the bar is rotated such that a curved portion 66 of the bar contacts the striker plate 22 and causes a camming action against it. This camming action further tightens the door B in the door frame to prevent inadvertent or unwelcome opening of the door. Such camming action will urge the door B in the direction of arrow 68 with respect to the striker plate 22 which is fixedly secured in the door frame C as is illustrated in FIG. 1.

It should be noted that the bar brace 20 is preferably reversible and can hold the locking bar 18 out at different distances from the door B. In this connection, the apertures 42,44 in bar brace ends 38,40 may be positioned at different heights from the bar brace body portion 36. These heights may differ by approximately one-quarter inch to thereby enable a person to align the locking bar 18 with different thicknesses of doors B and different heights of striker plate apertures 58. This capability thus allows the locking tip 34 of the locking bar to correctly fit into the striker plate aperture.

Figure 6:
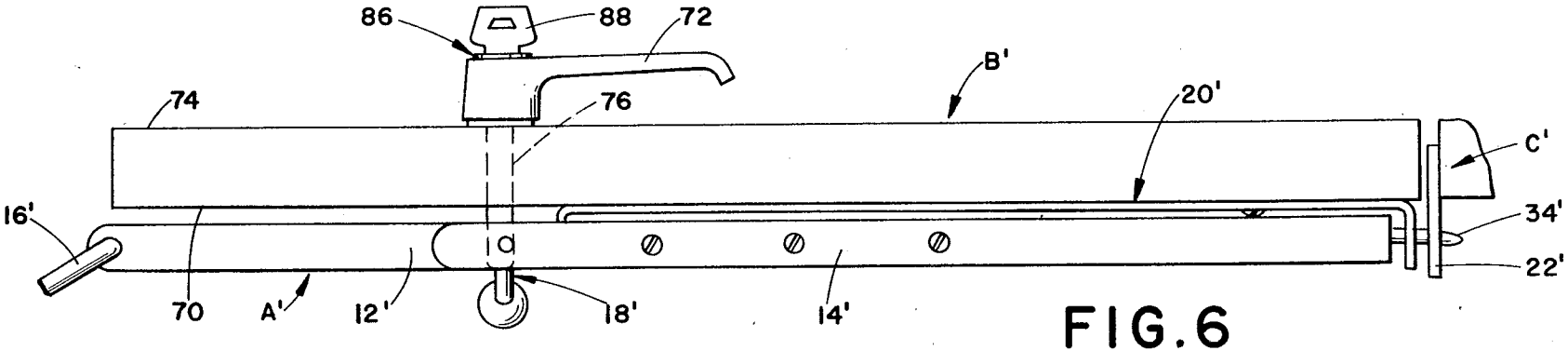
FIG. 6 is a view similar to FIG. 2 showing a first alternate embodiment of a bar type lock installed on a door in accordance with the invention.
Figure 7:
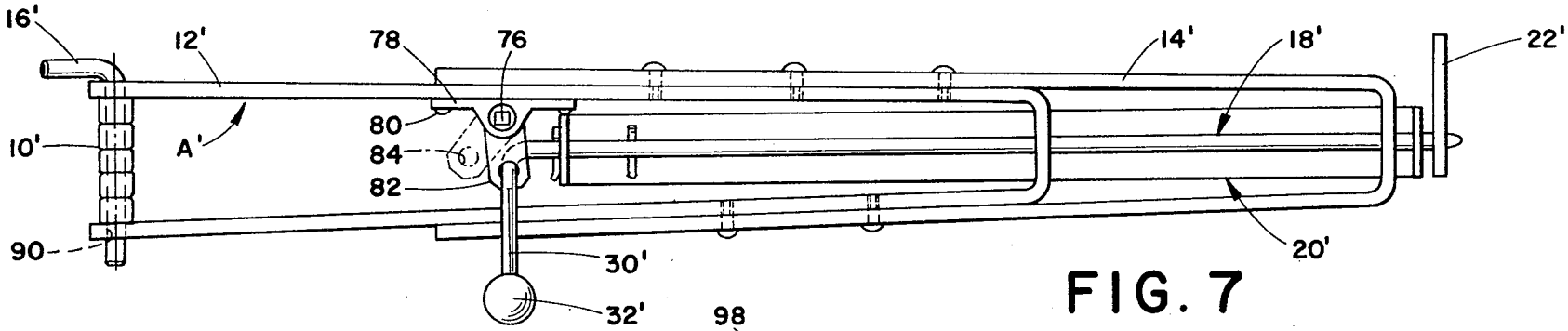
FIG. 7 is a side elevational view of the bar type lock of FIG. 6.

FIGS. 6 and 7 show a first alternate embodiment of the invention. For easy of illustration and appreciation of this modified construction, like components are identified by like numerals with a primed (') suffix and new components are identified by new numerals.

More particularly, FIG. 6 shows a bar type lock A' secured to a door B'. As with the preferred embodiment, the bar type lock A' includes first and second frame members 12',14', a locking bar 18', and a bar brace 20'. A striker plate 22' is secured to a door frame C'. All of these components of the bar type lock A' are secured to a first side 70 of the door B'. In this embodiment, however, there is a handle 72 extending from a second side 74 of the door B'. This handle 72 facilitates actuation of the bar type lock A' from the second side 74 of the door.

With respect now also to FIG. 7, the handle 72 actuates a square shank rod 76 which extends through the door B'. The square shank 76 rotates in a housing 78 which can be secured via conventional fasteners 80 to the frame members 12',14' of the bar type lock A'. The square shank 76 is secured to and actuates a plate 82 which, in turn, moves the handle portion 30' of the bar 18'. The plate 82 has an aperture 84 through which the handle portion 30' of the bar 18' passes such that when the plate moves, as is illustrated in dashed lines in FIG. 7, the bar handle portion 30' moves with it. Since the plate 82 has such a short throw due to its proximity to the square shank 76, movement of the plate will cause not only a longitudinal but also a rotational movement of the bar 18'.

Thus, when the plate 82 is in the dashed line position of FIG. 7, the handle portion 30' of the bar 18' is moved away from the striker plate 22' and at the same time the handle portion is rotated upwardly to a generally horizontal position. In this way, the bar type lock A' may be locked from the outside of the door B' through the actuation of the handle 72. To control the actuation of the handle 72, a key actuated lock 86 may be provided.

One conventional type of locking mechanism which will accomplish the above-delineated objects is manufactured and/or distributed by the Dor & Dor Company as well as by half a dozen other companies. In this conventional type of lock, the square shank 76 is free spinning when a key 88 is removed from the lock 86 so that emergency egress may be obtained from a locked building even from the inside simply by lifting up the handle portion 30' of the locking bar 18' and moving it longitudinally away from the striker plate 22'.

The bar type lock A' is secured to the door hinge 10' by the pin 16' which extends through apertures 90 in the first frame member 12', as in the preferred embodiment.

Figure 8:
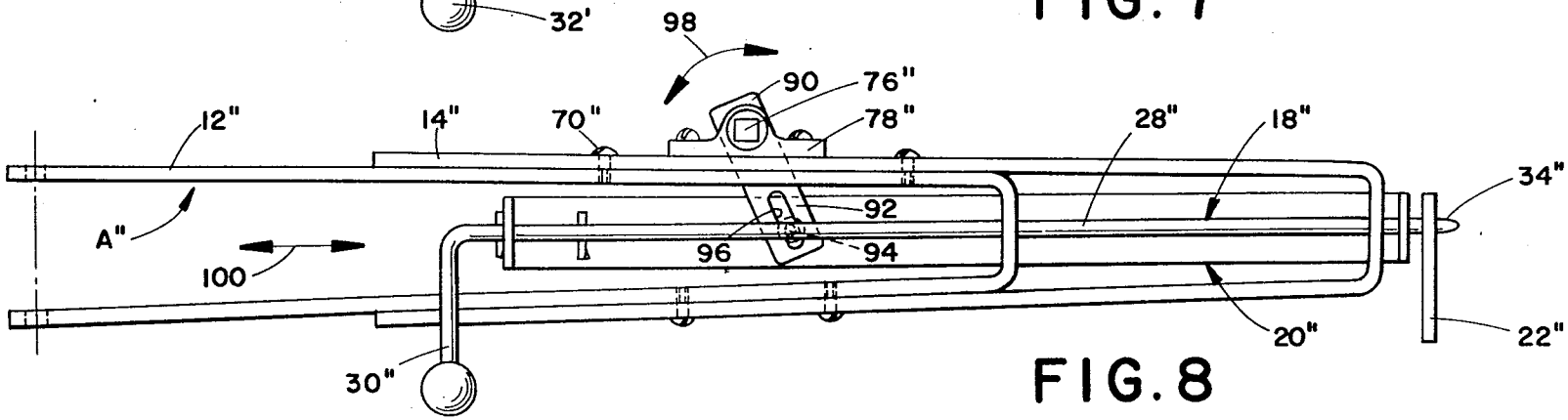
FIG. 8 is a side elevational view of a second alternate embodiment of the subject bar type lock.

FIG. 8 shows a second alternate embodiment of the invention. For ease of illustration and appreciation of this embodiment, like components are identified by like numerals with a double-primed (") suffix and new components are identified by new numerals.

More particularly, FIG. 8 shows a bar type lock A" which is provided with a handle actuation mechanism operable from the other side of the door as with the embodiment of FIGS. 6 and 7. However, in this embodiment, a square shank rod 76" is positioned in a holder 78" atop the first and second frame members 12",14". Also, a large rectangular plate 92 actuates a locking bar 18" through cooperation with a member 94, secured to the locking bar, which juts out perpendicularly from the bar body portion 28" of the bar. This jutting member 94 is positioned within an elongated slot 96 of the plate 92 such that when the square shank 76" is rotated, and hence the plate is rotated in the direction shown by the arrow 98, the bar 24" is moved horizontally in the direction shown by the arrow 100.

In this case, however, because the throw of the plate 92 is longer, the plate 92 is incapable of raising the handle portion 30" of the locking bar 18". Thus, the bar 18" is only moved horizontally and is not rotated as opposed to the embodiment of FIGS. 6 and 7. In the embodiment of FIG. 8, therefore, the locking bar 18" is not provided either with an angled second bar end or with curved and flattened portions on the bar end. Instead, the bar 18" has a straight bar end 34". On the other hand, in the embodiment of FIGS. 6 and 7, the bar second end 34' is angled and is provided with curved and flattened portions similar to bar second end 34 in the preferred embodiment.

It should be noted that in FIG. 7 the bottom aperture of the striker plate 22' is being used whereas in FIG. 8 the top aperture of the striker plate 22" has the locking tip 34" extending therethrough.

The bar type lock of the present invention is quite strong since it braces the entire width of the associated door thereby making it extremely difficult to break open the door. To strengthen the door even further, the conventional mounting screws of the hinge can be replaced with three to four inch long screws which pierce the studs adjacent the door frame. Similarly, the striker plate can also be mounted with long screws. The shear resistance provided by such screws in combination with the reinforced frame of the locking bar makes the door almost impossible to break open.

Preferably, the lock frame members, as well as the bar brace 20, are made from aluminum or an equally light and strong material. On the other hand, the locking bar and the striker plate are preferably made of steel or an equally hard material for strength and durability.

Although the invention has been shown and described with respect to the preferred embodiment and alternate embodiments, modifications and alterations will occur to others upon a reading and understanding of the specification. It is intended to include all such modificatins and alterations insofar as they come within the scope of the claims or the equivalents thereof.

What is claimed is:

1. A bar type lock mechanism adapted for use on a door or the like having first and second edges with the second edge being positioned adjacent a striker plate when the door is closed, the lock mechanism comprising:

a locking bar for selectively locking an associated door in a closed position, said locking bar including a main portion having a longidudinal axis, a first end having a locking portion, and a second end having a handle portion;

a frame means secured to an associated door frame of said associated door for slidably and rotatably supporting said locking bar for movement between a retracted position wherein said locking portion is retracted from the second edge of said associated door, and a projected position wherein said locking portion extends past the door second edge, wherein said frame means includes at least one frame member and further includes a bar brace for strengthening and guiding said locking bar, said bar brace being adapted to be secured to said associated door and including a pair of spaced means for supporting said locking bar; and, said locking bar locking portion having a flattened side and a curved side, said flattened side of said locking portion contacting a striker plate of said associated door when said locking bar is first placed into the projected position, said locking portion then being rotatable to its curved side to generate a camming action against the striker plate thereby more securely closing the door.

2. The mechanism of claim 1 wherein said locking portion is canted with respect to the longitudinal axis of said locking bar main portion to enhance said camming action.

3. The mechanism of claim 1 wherein said frame means comprises first and second cooperating frame members, said frame members being secured to each other and being relatively adjustable with respect to each other whereby the lock mechanism is adapted for use on different widths of doors.

4. The mechanism of claim 3 wherein one end of said first frame member is adapted to be secured to a hinge of said associated door.

5. The mechanism of claim 1 wherein said locking bar and said frame means are adapted for positioning on a first side of an associated door.

6. The mechanism of claim 5 further comprising means adapted to be positioned on a second side of an associated door for accommodating opening and closing the door from the second side thereof, said means including:

a square shank rod selectively rotatable and having first and second ends, said square shank rod extending through the associated door; and a handle means at said first end of said square shank rod for rotating said square shank rod.

7. The mechanism of claim 6 further comprising:

a housing means for housing and rotatably supporting said square shank rod, said housing means being secured to said frame means; and, a plate means to which said second end of said square shank rod is secured, said plate means operably engaging said locking bar whereby rotation of said square shank rod causes rotation of said plate means thereby moving said locking bar.

8. The mechanism of claim 7 wherein rotation of said plate means causes both rotation and longitudinal movement of said locking bar.

9. The mechanism of claim 6 wherein said handle means includes a key cylinder requiring actuation by a key to enable said handle means to turn said square shank rod.

10. The mechanism of claim 1 further comprising a pair of stop members provided on said locking bar, said stop members serving as end stops for locking bar movement.

11. A door lock for a hinged door having a hinge edge and an opposing latch edge which is positioned adjacent a striker plate when the door is closed, the door lock comprising:

a locking bar for locking the door, said bar including a straight main portion defining the longitudinal axis of said locking bar, a canted first end defining a locking portion, and a bent second end defining a handle portion;

first and second frame members secured to each other for slidably and rotatably supporting said locking bar, said frame members being relatively adjustable with respect to each other to enable the door lock to be used on different widths of doors and a transverse aperture being provided in each of said frame members through which aperture said locking bar is adapted to extend for both sliding and rotating motion, and wherein at least one of said first and second frame members is operatively connected to the door; and, said locking portion having a flattened side and a curved side such that a camming action can be generated against the striker plate, said flattened side of said locking portion initially contacting the striker plate and upon rotation of said locking portion said curved side coming into contact with said striker plate to generate said camming action.

12. The lock of claim 11 further comprising a bracing member secured to the door for bracing and supporting said locking bar, said bracing member including a main portion having a longitudinal axis and a pair of end portions extending generally transverse to said longitudinal axis of said main portion, an aperture being provided in each end portion to allow said locking bar to extend therethrough.

13. The lock of claim 12 wherein said end portion apertures in said bracing member are positioned at different heights from said bracing member main portion to enable one end of said bar to be located at a different distance outwardly from the door than the other end of said bar.

14. The lock of claim 11 wherein one of said frame members is secured to a hinge of the door and wherein the door can be hinged on either side.

15. The lock of claim 11 wherein said locking bar and said first and second frame members are positioned on a first side of the door and further comprising:

a square shank rod adapted for rotation and having first and second ends, said square shank rod extending through the door from said first side to a second side;

a handle secured to a first end of said square shank rod for rotation thereof, said handle being positioned on said second side of the door;

a rod housing in which said square shank rod rotates, said housing being secured to at least one of said first and second frame members; and, a plate secured to a second end of said square shank rod, said plate being operably connected to said locking bar whereby rotation of said square shank rod causes rotation of said plate and movement of said locking bar.

16. The lock of claim 15 wherein said movement of said locking bar comprises longitudinal movement.

17. The lock of claim 16 wherein said movement of said locking bar also comprises rotational movement.

18. The lock of claim 11 wherein said two frame members are adjustably secured with respect to each other for adapting the lock to use with different door widths.

19. A bar type lock mechanism adapted for use on a door or the like having first and second edges with the second edge being positioned adjacent a striker plate when the door is closed, the lock mechanism comprising:

a locking bar for selectively locking an associated door in a closed position, said locking bar including a main portion having a longitudinal axis, a first end having a locking portion, and a second end having a handle portion; and, a frame means operably connected to said associated door for slidably and rotatably supporting said locking bar for movement between a retracted position wherein said locking portion is retracted from the second edge of said associated door, and a projected position wherein said locking portion extends past the door second edge said frame means comprising:

a first frame member, a second frame member, said two frame members being secured to each other and being adjustable with respect to each other to adapt the lock mechanism for use on doors of different widths, and a bar brace for strengthening and guiding said locking bar, said bar brace being secured to said associated door.

20. The lock mechanism of claim 19 wherein said first and second frame members are each approximately U-shaped and each having diverging legs so that said two frame members can be partially nested together for strength, said locking bar extending through colinear apertures in said nested frame members along a longitudinal axis of said frame members.

21. The lock mechanism of claim 19 wherein said locking bar and said frame means are adapted for positioning on a first side of said associated door and further comprising means adapted to be positioned on a second side of said associated door for accommodating the opening and closing of the door from the second side thereof.

22. The lock mechanism of claim 21 wherein said means comprises:

a square shank rod adapted for rotation and having first and second ends, said square shank rod extending through the door from said first side to a second side;

a handle secured to a first end of said square shank rod for rotation thereof, said handle being positioned on said second side of the door;

a rod housing in which said square shank rod rotates, said housing being secured to at least one of said first and second frame members; and, a plate secured to a second end of said square shank rod, said plate being operably connected to said locking bar whereby rotation of said square shank rod causes rotation of said plate and movement of said locking bar.

* * * * *